US008858154B2

(12) United States Patent
Guelich

(10) Patent No.: US 8,858,154 B2
(45) Date of Patent: Oct. 14, 2014

(54) PUMP SYSTEM AND METHOD FOR DELIVERING MULTI-PHASE MIXTURES

(75) Inventor: Johann Guelich, Villeneuve (CH)

(73) Assignee: Sulzer Pumpen AG, Winterthur (CH)

( * ) Notice: Subject to any disclaimer, the term of this patent is extended or adjusted under 35 U.S.C. 154(b) by 887 days.

(21) Appl. No.: 12/529,524

(22) PCT Filed: Feb. 14, 2008

(86) PCT No.: PCT/EP2008/051767

§ 371 (c)(1),
(2), (4) Date: Sep. 1, 2009

(87) PCT Pub. No.: WO2008/107276

PCT Pub. Date: Sep. 12, 2008

(65) Prior Publication Data

US 2010/0098525 A1 Apr. 22, 2010

(30) Foreign Application Priority Data

Mar. 8, 2007 (EP) ..... 07103800

(51) Int. Cl.
*F04D 31/00* (2006.01)

(52) U.S. Cl.
CPC ..... *F04D 31/00* (2013.01); *Y10S 415/901* (2013.01)
USPC ..... 415/1; 415/100; 415/901

(58) Field of Classification Search
CPC ..... F04D 19/046; F04D 31/00; F04D 15/02; F04D 21/00
USPC ..... 415/5–6, 199.2, 901, 99, 100, 198.1, 415/199.1
See application file for complete search history.

(56) References Cited

U.S. PATENT DOCUMENTS

| | | | | |
|---|---|---|---|---|
| 4,981,175 | A | 1/1991 | Powers | |
| 5,254,292 | A * | 10/1993 | Gabryelczyk et al. | 261/76 |
| 5,377,714 | A * | 1/1995 | Giannesini et al. | 137/2 |
| 5,961,282 | A * | 10/1999 | Wittrisch et al. | 415/199.6 |
| 6,989,103 | B2 * | 1/2006 | Mohsen et al. | 210/708 |

FOREIGN PATENT DOCUMENTS

FR 2 788 815 A1 7/2000

OTHER PUBLICATIONS

Culver, Well Pumps, Geo Heat Center Bulletin, Mar. 1998.*

* cited by examiner

*Primary Examiner* — Ned Landrum
*Assistant Examiner* — Woody A Lee, Jr.
(74) *Attorney, Agent, or Firm* — Kilpatrick Townsend & Stockton LLP

(57) ABSTRACT

A pump system (1) is provided for the pumping of multiphase mixtures which includes a pumping apparatus (3) for multiphase mixtures with at least one liquid phase and at least one gaseous phase. The pumping apparatus (3) contains one or more axial compression stages with one respective axial impeller each and one or more pumping stages with a respective one radial impeller each which are arranged adjoining the axial compression stage or stages, wherein the pump system (1) additionally includes a separator (2) at the inlet side of the pumping apparatus (3) to separate a portion of the gaseous phase and wherein the pumping apparatus (3) is configured for delivery heads larger than 50 m.

17 Claims, 3 Drawing Sheets

PUMP SYSTEM AND METHOD FOR DELIVERING MULTI-PHASE MIXTURES

CROSS REFERENCE TO RELATED APPLICATIONS

Figure 1:
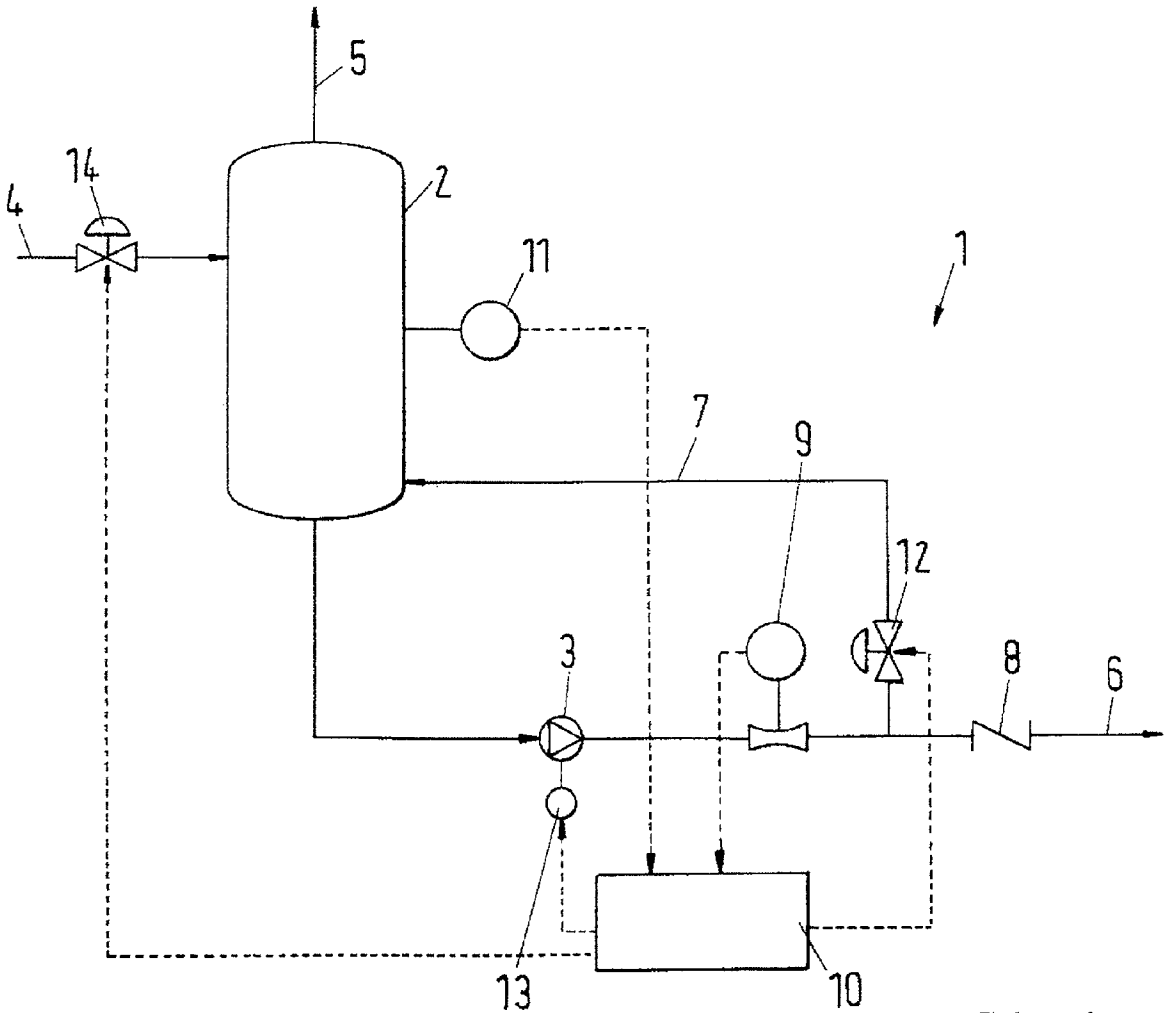

This application is a National Stage of International Application No. PCT/EP2008/051767 filed Feb. 14, 2008 and which claims the benefit of European Patent Application No. 07103800.4, the disclosures of all applications being incorporated herein by reference.

The invention relates to a pump system for the pumping of multiphase mixtures in accordance with the preamble of claim 1 and to a method for the pumping of multiphase mixtures in accordance with the preamble of claim 7 as well as to a pumping unit using such a pump system.

The problem occurs in the pumping of multiphase mixtures such as crude oil which also contains natural gas and frequently also water and solid portions such as sand in addition to oil that the efficiency of the pump apparatus used falls as the gas portion in the multiphase mixture rises. The use of pump apparatus with radial impellers is, for example, already no longer possible or economic at low gas densities from a volumetric gas/liquid ratio of more than 3 to 5%. In conventional pumping units, with a higher gas portion, the gaseous phase of the multiphase mixtures is therefore separated from the liquid phase in a separator and the two phases are pumped separately, with radial pumps being used for the pumping of the liquid phase. The disadvantage of such pumping systems includes the fact that the separator used therein for the phase separation has a comparatively large volume.

For applications where not much room is available, a multiphase pump is therefore used for the pumping of the liquid portion after the separator which permits a separator with a smaller volume to be used since the multiphase pump is capable of pumping multiphase mixtures with a volumetric gas/liquid ratio of more than 5%. The use of multiphase pumps, however, has the disadvantage that the delivery head which can be generated therewith is restricted to a maximum of 1000 m.

For applications where not much room is available and, optionally, a larger delivery head is required, special pumping apparatus for multiphase mixtures have moreover been developed which contain at least one axial compression stage at the inlet side to reduce the volumetric gas/liquid ratio of the multiphase mixtures to be pumped so much that subsequently conventional pump stages with radial impellers can be used. A common shaft is normally provided for the axial compression stage and the radial pumping stages. A pumping apparatus for multiphase mixtures is disclosed in the document U.S. Pat. No. 5,961,282 which includes at least one axial pumping stage and at least one radial pumping stage which is arranged adjoining the axial pumping stage. According to the document U.S. Pat. No. 5,961,282, the disclosed pumping apparatus is able to pump multiphase mixtures with any desired volumetric gas/liquid ratio, with a volumetric gas/liquid ratio of at least 40% being mentioned in an example. In accordance with studies of the applicant, the pumping apparatus disclosed for multiphase mixtures in U.S. Pat. No. 5,961,282 is in particular not economic at higher gas/liquid ratios of, for example, 40% and higher and is not ideal from the point of view of reliability since a larger number of axial pumping stages are required at higher gas/liquid ratios, which make the pumping apparatus more expensive, and/or higher speeds of 5,000 revolutions per minute and more are required, which increases the effort and/or expense for storage and lubrication and has a negative effect on the reliability.

It is the object of the invention to provide a method for the pumping of multiphase mixtures as well as a pumping system and a pumping unit for multiphase mixtures including such a pumping system which are suitable for a volumetric gas/liquid ratio of larger than 20% or larger than 40% or larger than 60% and which permit a comparatively compact and space-saving design and delivery heads of 50 m to 2000 m and larger in dependence on the number of pumping stages.

This object is satisfied in accordance with the invention by the pump system defined in claim 1 and by the method defined in claim 7 as well as by the pumping unit defined in claim 12.

The pump system in accordance with the invention for the pumping of multiphase mixtures includes a pumping apparatus for multiphase mixtures with at least one liquid phase and at least one gaseous phase. The pumping apparatus contains one or more axial compression stages with a respective one axial or semi-axial impeller each and one or more pumping stages with a respective one radial impeller each which are arranged adjoining the axial compression stage or stages, wherein the pump system additionally includes a separator at the inlet side of the pumping apparatus to separate the gaseous phase or a portion thereof, and wherein the pumping apparatus is configured for delivery heads larger than 50 m. In a typical application, the pumping apparatus is configured to pump a multiphase mixture with a volumetric gas/liquid ratio of up to 20% or up to 30%. In an advantageous embodiment variant, the impeller in one or more, or all, of the axial compression stages is provided with vanes made in helico-axial form. In a further advantageous embodiment variant, the pumping apparatus for multiphase mixture contains one to six axial compression stages, in particular two to four axial compression stages.

In an advantageous embodiment, the pumping apparatus for multiphase mixtures has a nominal flow rate of $Q_{max}$ and the separator has a volume of a maximum of $V=60s \cdot Q_{max}$ or of a maximum of $V=20s \cdot Q_{max}$.

In a further advantageous embodiment, a return line is provided at the outlet side of the pumping apparatus for multiphase mixtures to return multiphase mixture to the separator.

In a further advantageous embodiment, the pump system includes a control unit to control the speed of the pumping apparatus for multiphase mixtures, with at least one filling level sensor being provided at the separator which is connected to the control unit to regulate the filling level of the liquid phase or phases in the separator by varying the speed of the pumping apparatus.

In the method in accordance with the invention of pumping multiphase mixtures with at least one liquid phase and at least one gaseous phase, a multiphase mixture is pumped by means of a pumping apparatus which contains one or more axial compression stages with a respective axial or semi-axial impeller each and one or more pumping stages with a respective radial impeller each which are arranged adjoining the axial compression stage or stages. In addition, a portion of the gaseous phase is separated from the liquid phase in a separator at the inlet side of the pumping apparatus and the liquid phase or the residual multiphase mixture is pumped to a delivery head of more than 50 m or more than 100 m or more than 200 m by means of the pumping apparatus.

In an advantageous embodiment of the method, the filling level of the liquid phase or phases is detected in the separator by means of one or more filling level sensors and is controlled or regulated automatically as required by varying the speed of the pumping apparatus.

In an advantageous embodiment variant, the supply of multiphase mixture to the separator is interrupted when the filling level in the separator has exceeded a maximum permitted value and/or the gas discharge from the separator via a gas discharge line is interrupted by closing thereof when the filling level in the separator has reached the inlet of the gas discharge line. In a further advantageous embodiment variant, the flow rate in a pumping line connected to the pumping apparatus at the outlet side is interrupted, for example by means of a check valve or of a blocking means when the pumping pressure and/or flow rate at the outlet side falls below a minimum value and, in a further advantageous embodiment, multiphase mixture is returned to the separator via a return line when the filling level in the separator falls below a minimum value.

The invention additionally includes a pumping unit including a pump system in accordance with one or more of the embodiments and embodiment variants described above and/or configured for the carrying out of a method in accordance with the description above.

The pump system in accordance with the invention and the method in accordance with the invention have the advantage that the volume of the separator can be kept small since no special demands have to be made on the phase separation in the separator thanks to the combination of a separator with a following pumping apparatus for multiphase mixtures with a high gas portion. The pumping apparatus also still satisfactorily pumps the liquid portion of the multiphase mixture out of the separator when only a portion of the gaseous phase or phases are separated and the liquid portion contains still larger quantities of gas. The separator volume can therefore be selected to be substantially smaller than is possible in comparable pumping systems with radial pumps. Furthermore, installations for the gas separation in the separator can largely or completely be dispensed with in the pump system and method in accordance with the invention so that the weight of the separator can be lowered. The control and regulation methods described in the embodiments and in the embodiment variants furthermore permit trouble-free operation since the filling level in the separator is thus maintained at a safe value even with a small volume and unwanted operating states such as a lack of filling or over-filling of the separator are avoided or at least do not have any damaging effects on the pump system.

It is also of advantage that both the gas portion of the multiphase mixtures to be pumped and the achievable delivery head can be comparatively high despite the comparatively low space requirements. The volumetric gas/liquid ratio can thus amount, for example, to 40% or 60% or more, with respect to the thermodynamic conditions at the inlet of the pump system, whereas the delivery head can amount to between 50 m and 2000 m or more depending on the number and configuration of the radial pumping stages.

The above description of embodiments only serves as an example. Further advantageous embodiments can be seen from the dependent claims and from the drawing. Furthermore, individual features from the embodiments and embodiment variants described or shown can also be combined with one another within the framework of the present invention to form new embodiments.

Figure 2:
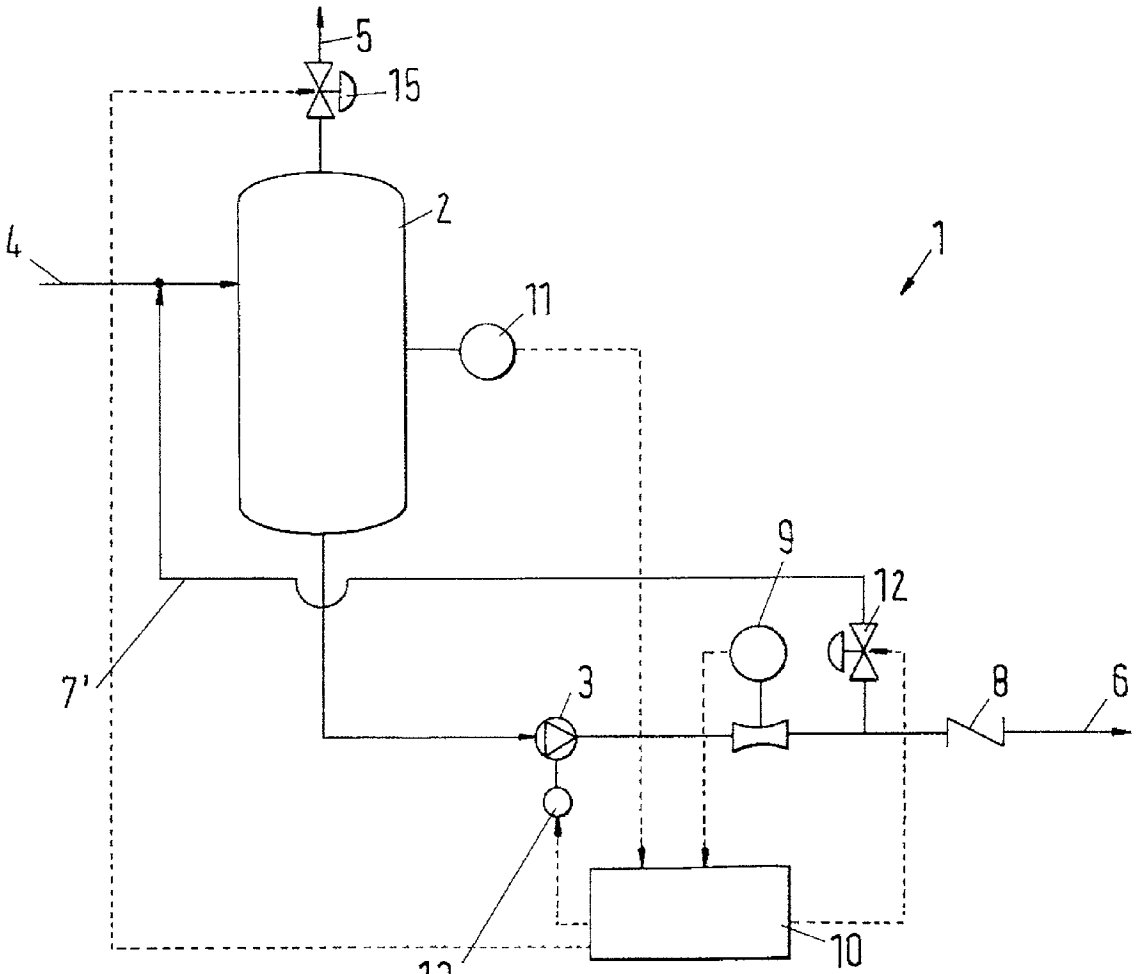
Figure 3:
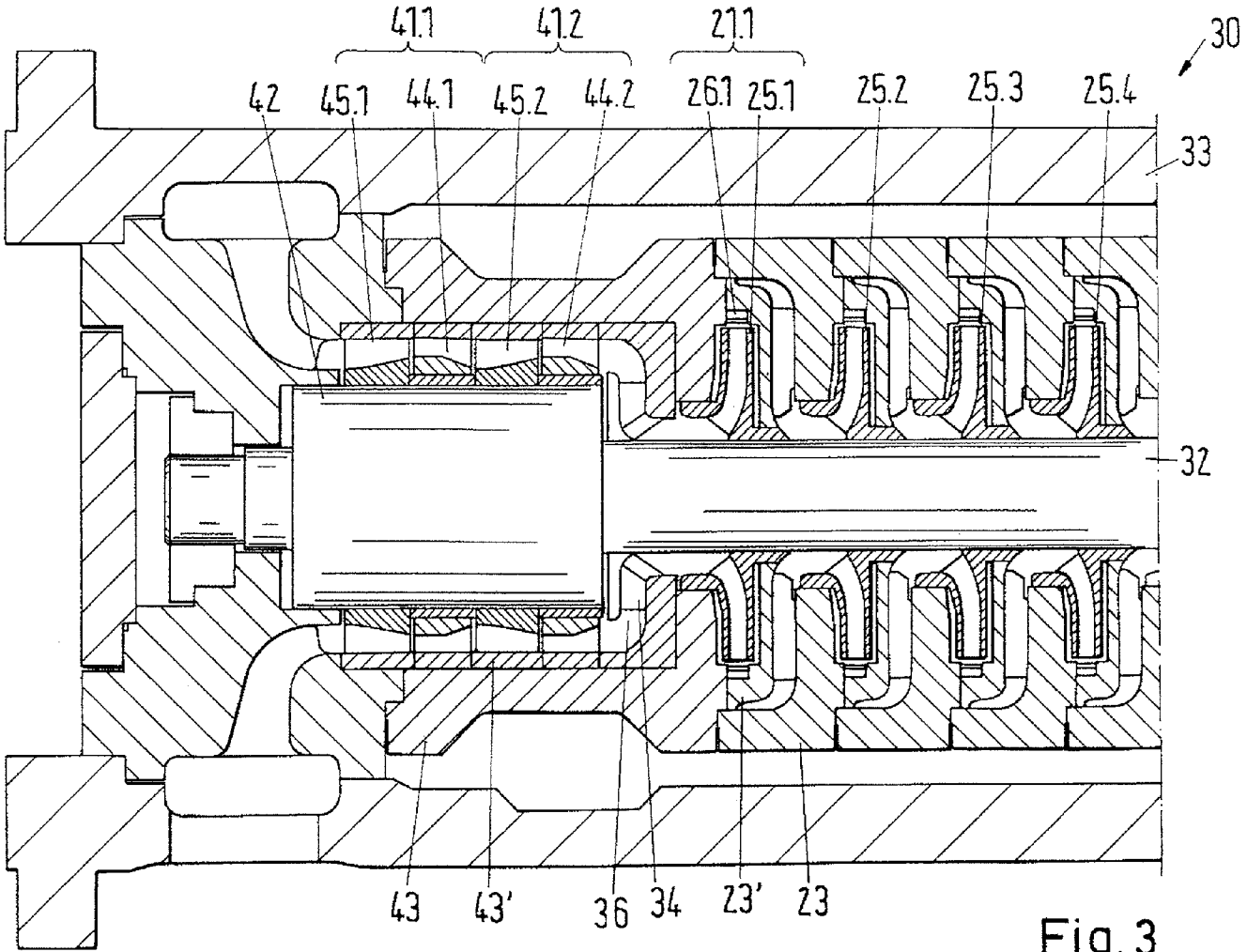

The invention will be explained in more detail in the following with reference to the embodiments and to the drawing. There are shown:

FIG. 1 an embodiment of a pump system in accordance with the present invention;

FIG. 2 a second embodiment of a pump system in accordance with the present invention; and FIG. 3 an embodiment of a pumping apparatus for use in a pump system in accordance with the present invention.

The pump system 1 for the pumping of multiphase mixtures shown in FIG. 1 in accordance with the present invention includes a pumping apparatus 3 for multiphase mixtures with at least one liquid phase and at least one gaseous phase. The pumping apparatus 3 contains one or more axial compression stages with one respective axial or semi-axial impeller each and one or more pumping stages with a respective one radial impeller each which are arranged adjoining the axial compression stage or stages, wherein the pump system 1 additionally includes a separator 2 at the inlet side of the pumping apparatus to separate the gaseous phase or a portion thereof and wherein the pumping apparatus is configured for delivery heads larger than 50 m. The pumping apparatus 3 is advantageously configured to pump a multiphase mixture with a volumetric gas/liquid ratio of up to 20% or up to 30%.

In an advantageous embodiment variant, the impeller in one or more, or all, of the axial compression stages is provided with vanes made in helico-axial form. In a further advantageous embodiment variant, the pumping apparatus 3 for multiphase mixture contains one to six axial compression stages, in particular two to four axial compression stages. Pump systems for multiphase mixtures can be manufactured with the number of axial compressor stages set forth which are particularly advantageous from an economic aspect. An embodiment of a pumping apparatus for use in a pump system in accordance with the present invention will be explained in more detail within the framework of the description of FIG. 3.

The pump system 1 can additionally include one or more of the additional components described in the following from case to case. For example, the pump system can contain a pumping line 4 at the inlet side, which is expediently connected to the separator 2 to supply the multiphase mixture to be pumped to the separator, or a gas discharge line 5 which is expediently connected to the separator 2 to lead off the portion of the gaseous phase or phases separated in the separator. If the gaseous phase or phases are under overpressure and/or lighter than air, they can escape through the gas discharge line 5 without additional pumping means. Furthermore, the pump system 1 can contain a pumping line 6 at the outlet side which is expediently connected to an outlet of the pumping apparatus 3 to forward liquid phases and/or multiphase mixtures pumped by the pumping apparatus. A check-valve or blocking means 8 is advantageously provided in the pumping line 6 at the outlet side to interrupt the flow rate when the pumping pressure and/or the flow rate at the outlet side falls beneath a minimum value. A flow sensor 9 can be provided in the pumping line 6 at the outlet side for the detection of the flow rate at the outlet side, for example.

In an advantageous embodiment, the pumping apparatus 3 for multiphase mixtures has a maximum flow rate of $Q_{max}$ and the separator 2 has a volume of a maximum of $V=60s \cdot Q_{max}$ or of a maximum of $V=20s \cdot Q_{max}$.

In a further advantageous embodiment, the pump system 1 includes a drive 13 for the driving of the pumping apparatus 3 for multiphase mixtures and a control unit 10 which is connected to the drive 13 to control the speed of the pumping apparatus. At least one filling level sensor 11 is advantageously provided at the separator 2 and is connected to the control unit 10 to automatically regulate the filling level of the liquid phase or phases in the separator by varying the speed of the pumping apparatus 3.

In a further advantageous embodiment, a return line 7 and a blocking valve 12 for the blocking of the return line 7 are provided at the outlet side of the pumping apparatus 3 for multiphase mixtures to return multiphase mixture to the separator 2, in particular when the filling level in the separator falls below a minimum value.

The pump system can additionally include a blocking valve or blocking means 14 which can, for example, be connected to the control unit 10 to interrupt the supply of multiphase mixture to the separator 2 via the pumping line 4 at the inlet side. The interruption of the supply of multiphase mixture to the separator is above all advantageous when the filling level in the separator has exceeded a maximum permitted value.

FIG. 2 shows a second embodiment of a pump system for the pumping of multiphase mixtures in accordance with the present invention. The pump system 1 shown includes a pumping apparatus 3 for multiphase mixtures with at least one liquid phase and at least one gaseous phase. The pumping apparatus 3 contains one or more axial compression stages with a respective one axial or semi-axial impeller each and one or more pumping stages with a respective one radial impeller each which are arranged adjoining the axial compression stage or stages, wherein the pump system 1 additionally includes a separator 2 at the inlet side of the pumping apparatus to separate the gaseous phase or a portion thereof and wherein the pumping apparatus is configured for delivery heads larger than 50 m.

The second embodiment differs from the first only in that, in the second embodiment, a return line 7 drawn in FIG. 2 opens into a pumping line 4 of the pump system 1 at the inlet side, whereas the return line opens into the separator 2 in the example shown in FIG. 1. In both cases, the return line 7 serves to return liquid phases and multiphase mixtures pumped by the pumping apparatus 3 into the separator 2 and to avoid too large a fall of the filling level in the separator. Furthermore, in the return variant shown in FIG. 2, the returned multiphase mixture is subjected to the same separation process in the separator as the newly supplied multiphase mixture. Furthermore, a blocking valve 15 for the blocking of a gas discharge line 5 of the separator can be seen in FIG. 2 which, however, only represents an embodiment variant which will be described separately in the following since it can be used independently of the embodiment. The blocking valve 14 described within the framework of FIG. 1 is, in contrast, not drawn in again in FIG. 2, although it likewise represents an embodiment variant which can be used independently of the embodiment. The remaining features, properties and embodiments and embodiment variants of the second embodiment are identical to those of the first embodiment so that a repetition of the description will be dispensed with in the following.

As mentioned and as shown in FIG. 2, the pump system can include a blocking valve or blocking means 15 which can, for example, be connected to the control unit 10 for the blocking of a gas discharge line 5 connected to the separator 2. The blocking of the gas discharge line 5 is above all advantageous if the filling level in the separator has exceeded a maximum permitted value, for example if the filling level has reached the gas discharge line.

FIG. 3 shows an embodiment of a pumping apparatus 30 for the pumping of multiphase mixtures for use in a pump system in accordance with the present invention. The pumping apparatus 30 in the embodiment includes a first stage group with one or more, for example two, axial compression stages 41.1, 41.2, with one axial or semi-axial impeller each to reduce the volumetric gas/liquid ratio of the multiphase mixtures and to homogenise the phase distribution of the same as well as additionally a second stage group with at least one pumping stage 21.1 with a radial impeller 25.1 which is arranged at the outlet side of the first stage group. The one or more axial compression stages 41.1, 41.2 can e.g. be made in accordance with the pumping or compression stages described in the document GB-A-1 561 454 or in the document EP 0 486 877 A1. In addition, the first stage group can, for example, include one or more axial compression stages with an axial impeller at the inlet side and one or more axial compression stages with a semi-axial impeller at the outlet side. Furthermore, as shown in FIG. 3, the second stage group of the pumping apparatus 30 for the pumping of multiphase mixtures can be equipped with, for example, two, three, four or more pumping stages for the achieving of larger delivery heads.

The axial compression stages 41.1, 41.2 of the first stage group and the radial pumping stages 21.1 of the second stage group are advantageously each arranged in series. It is, however, also possible, for example, to divide the radial pumping stages of the second stage group into two oppositely running sub-groups, whereby the axial thrust compensation is simplified.

In an advantageous embodiment, the one or ore axial compression stages 41.1, 41.2 of the first stage group each include one impeller 45.1, 45.2 which is made helico-axially and/or helico-axially closed and/or semi-axially, and at which one or more vanes, in particular at least two vanes, are formed. The vanes are advantageously e.g. fastened to a hub which can be pushed onto a shaft 32 of the pumping apparatus 30 for the pumping of multiphase mixtures. The ratio between the inner diameter and the outer diameter of the one or more vales is typically between 0.3 and 0.95 and advantageously between 0.6 and 0.9 at the inlet side. The one or more vanes can, for example, have an angle of entry between 2° and 50° and preferably between 4° and 25° as well as outlet angle which is between the entry angle and 60° and preferably between the entry angle and 25°. Furthermore, the vanes can have a profile which is formed by the intersection of the vanes with the surface of a cylinder coaxial to the impeller and in which the angle of inclination of the profile to the axial direction reduces continuously from the entry edge of the vane up to the exit edge, for example in that the section substantially does not have any curvature in the direct environment of the entry edge and in that the steepness of a curve of the vane profile curvature increases continuously as a function of the axial spacing from the entry edge as the spacing from the entry edge increases.

In an advantageous embodiment, the first stage group includes a first housing 43, 43' and the second stage group includes a second housing 23, 23', with the two housings 43, 43', 23, 23' being connected to one another and with the two housing being able to be made up of a plurality of housing parts 43, 43', 23, 23'. In a further advantageous embodiment variant, the first and second stage groups include a common holding apparatus and/or a common housing 33 in which the first and second stage groups are arranged and which can, for example, contain a housing part which extends at least over a part of the first stage group as well as a part of the second stage group.

The one or more axial compression stages 41.1, 41.2 of the first stage group and the at least one pumping stage 21.1 of the second stage group advantageously each include one impeller 45.1, 45.2, 25.1-25.4 and a guide apparatus 44.1, 44.2, 26.1, wherein the guide apparatus 44.2 of the last axial compression stage 41.2 of the first stage group is in fluid-conducting communication with the impeller 25.1 of the first pumping stage 21.2 of the second stage group, for example via one or more connection passages or so-called return passages 36 which are provided in the housing or housings 33, 43, 43', 23, 23'. In an advantageous embodiment variant, guide elements 34 can be provided in the connection or return passage(s) 36.

In a further advantageous embodiment, one or more of the axial compression stages 41.1, 41.2 of the first stage group each include a diffuser 44.1, 44.2, in particular a diffuser with a plurality of guide elements, which is fixedly connected to the first housing 43, 43' and/or the common housing 33. The guide elements can be made as vanes, with the diffuser being able to have, for example, between 6 and 50 vanes, preferably between 12 and 30 vanes. The vanes can e.g. be aligned substantially tangentially to the flow at the inlet of the diffuser 44.1, 44.2 and substantially in the axial direction at the outlet. If the associated impeller, as shown in FIG. 3, has a hub with a diameter increasing in the pumping direction, the diffuser is advantageously provided at the centre with a hub or sleeve which has a reducing diameter in the pumping direction as well as, optionally, a line of intersection in an axial longitudinal section which extends axially parallel at the inlet side and/or at the outlet side.

In a further preferred embodiment, the one or more axial compression stages 41.1. 41.2 of the first stage group and the at least one pumping stage 21.1 of the second stage group have a common axis of rotation, for example in that the impeller or impellers 45.1, 45.2 of the one or more axial compression stages and the radial impeller 25.1 of the at least one pumping stage are arranged on a common shaft 32, 42. The common shaft can have a changed diameter, preferably an enlarged diameter, in the region 42 of the first stage group or a corresponding hub with an enlarged diameter. The first and second stage groups of the pumping apparatus 30 for the pumping of multiphase mixtures are advantageously provided with a common drive which is not shown in FIG. 3.

In the at least one pumping stage 21.1 of the second stage group, the impeller 25.1 advantageously includes one or more vanes for the acceleration of the multiphase mixtures to be pumped in an at least partially radial direction. The impeller can be open, half open or closed. The pumping stage 21.1 expediently includes a housing 33, 23 which can be made up of e.g. a plurality of housing parts 23, 23'. A guiding apparatus 26.1 is advantageously formed in the housing, which adjoins the impeller 25.1 at the outside and can be connected, e.g. via a ring space, to the impeller of the next pumping stage or to the outlet of the pumping device 30 for the pumping of multiphase mixtures.

The pumping device 30 for the pumping of multiphase mixtures is advantageously designed for a volumetric gas/liquid ratio of up to 15% or up to 20% or up to 30%, with respect to the thermodynamic conditions at the inlet of the first axial compression stage of the first stage group.

An embodiment of the method in accordance with the invention for the pumping of multiphase mixtures with at least one liquid phase and at least one gaseous phase will be described in the following with reference to FIGS. 1 and 2. In the method, a multiphase mixture is pumped by means of a pumping apparatus 3 which contains one or more axial compression stages with one respective axial or semi-axial impeller each and one or more pumping stages with one respective radial impeller each which are arranged adjoining the axial compression stage or stages. In addition, in the method, the gaseous phase or a portion thereof is separated in a separator 2 at the inlet side of the pumping apparatus 3 and the liquid phase or the residual multiphase mixture is pumped to a delivery head of more than 50 m or more than 100 m or more than 200 m by means of the pumping apparatus.

One of the difficulties in the pumping of multiphase mixtures is the irregular supply and composition of the multiphase mixture to be pumped which occurs in a particularly troublesome manner with a small volume of the separator. In an advantageous embodiment of the method, the filling level of the liquid phase or phases is therefore detected in the separator 2 by means of one or more filling level sensors 11 and is controlled or regulated automatically as required by varying the speed of the pumping apparatus 3.

In an advantageous embodiment variant, the supply of multiphase mixture to the separator 2 is interrupted, for example by means of a blocking valve 14 if the filling level in the separator has exceeded a maximum permitted value and/or the gas discharge from the separator 2 via a gas discharge line 5 is interrupted by the closing thereof, for example by means of a blocking valve 15 when the filling level in the separator has exceeded a maximum permitted value, for example when the filling level has reached the inlet of the gas discharge line 5. In a further advantageous embodiment variant, the flow rate in a pumping line 6 connected to the pumping apparatus 3 at the outlet side is interrupted, for example by means of a check valve or of a blocking means 8 when the pumping pressure and/or flow rate at the outlet side falls below a minimum value and, in a further advantageous embodiment, multiphase mixture is returned to the separator 2 via a return line 7 when the filling level in the separator falls below a minimum value. The mentioned embodiment variants of the method are particularly advantageous when the filling level in the separator 2 cannot be kept in the desired range despite varying the speed of the pumping device 3.

The invention additionally includes a pumping unit including a pump system for the pumping of multiphase mixtures in accordance with one or more of the embodiments and embodiment variants described above and/or configured for the carrying out of a method in accordance with the description above.

The pump system described above and the method described above of pumping multiphase mixtures are suitable for volumetric gas/liquid ratios of larger than 40% or larger than 60%, permit a comparatively compact and space-saving design and a safe operation despite a highly fluctuating supply of the multiphase mixture to be pumped and permit delivery heads of 50 m up to 2000 m and larger depending on the number of pumping stages.

The invention claimed is:

1. A pump system for pumping of multiphase mixtures, comprising:

a pumping apparatus for multiphase mixtures with at least one liquid phase and at least one gaseous phase, wherein the pumping apparatus comprises:

one or more axial compression stages, each of the axial compression stages comprising an axial or semi-axial impeller; and one or more pumping stages, each of the pumping stages comprising a radial impeller, wherein the pumping stages adjoin the axial compression stages;

a separator at an inlet side of the pumping apparatus to separate the gaseous phase or a portion thereof; and a gas discharge line connected to the separator, wherein the system is configured for the gaseous phase or the portion thereof to exit the apparatus through the gas discharge line without any additional pump; and a return line at an output side of the pumping apparatus to return multiphase mixture into the separator.

2. The pump system in accordance with claim 1, wherein the pumping apparatus comprises one to six axial compression stages.

3. The pump system in accordance with claim 1, wherein at least one of the axial compression stages comprises helico-axial vanes.

4. The pump system in accordance with claim 1, wherein the pumping apparatus has a maximum flow rate $Q_{max}$ and the separator has a volume of a maximum of $V=60s \cdot Q_{max}$.

5. The pump system in accordance with claim 1, further comprising:

a control unit to control a speed of the pumping apparatus; and at least one filling sensor disposed at the separator and connected to the control unit to regulate a filling level of the liquid phase in the separator by varying the speed of the pumping apparatus.

6. The pump system in accordance with claim 1, wherein the pumping apparatus is made for delivery heads larger than 50 m.

7. The pump system in accordance with claim 1, wherein the pumping apparatus comprises two to four axial compression stages.

8. The pump system in accordance with claim 1, wherein all of the axial compression stages comprise helicoaxial vanes.

9. A method for pumping a multiphase mixture with at least one liquid phase and at least one gaseous phase, the method comprising:

pumping the multiphase mixture utilizing a pumping apparatus, the pumping apparatus comprising:

one or more axial compression stages, each of the axial compression stages comprising an axial or semi-axial impeller;

one or more pumping stages, each of the pumping stages comprising a radial impeller; wherein the pumping stages adjoin the axial compression stages;

a separator at an inlet side of the pumping apparatus; and a gas discharge line connected to the separator;

separating the gaseous phase or a portion thereof in the separator;

allowing the gaseous phase or the portion thereof to exit the apparatus through the gas discharge line without using any additional pump; and leading the multiphase mixture back into the separator via a return line when a filling level in the separator has fallen below a minimum value.

10. The method in accordance with claim 9, further comprising detecting a filling level of the liquid phase in the separator utilizing a filling level sensor and automatically controlling or regulating the filling level of the liquid phase by varying the speed of the pumping apparatus.

11. The method in accordance with claim 9, further comprising interrupting a supply of multiphase mixture to the separator when a filling level in the separator has exceeded a maximum permitted value.

12. The method in accordance with claim 9, further comprising interrupting a flow rate in a pumping line connected to an outlet side of the pumping apparatus when the pumping pressure and/or flow rate at the outlet side falls below a minimum value.

13. The method in accordance with claim 12, wherein interrupting the flow rate comprises using a return valve.

14. A pumping plant comprising the pump system in accordance with claim 1.

15. The method in accordance with claim 9, wherein the pumping apparatus pumps the liquid phase or the multiphase mixture to a delivery head of more than 50 m.

16. The method in accordance with claim 9, further comprising interrupting the gaseous phase or the portion thereof from exiting the apparatus through the gas discharge line by closing the gas discharge line when a filling level in the separator has reached a maximum permitted value.

17. The method in accordance with claim 16, wherein the maximum permitted value is reached when the filling level has reached an inlet of the gas discharge line.

* * * * *